United States Patent [19]

Fritz

[11] 4,377,175

[45] Mar. 22, 1983

[54] APPARATUS FOR CLEANING ROLLER APPLICATORS

[76] Inventor: Stewart J. Fritz, 6935 E. Wilshire Dr., Scottsdale, Ariz. 85257

[21] Appl. No.: 179,231

[22] Filed: Aug. 18, 1980

Related U.S. Application Data

[63] Continuation-in-part of Ser. No. 97,929, Nov. 28, 1979, abandoned.

[51] Int. Cl.[3] ..... B08B 3/02

[52] U.S. Cl. ..... 134/138; 134/143; 134/149; 68/213

[58] Field of Search ..... 134/138, 139, 141, 143, 134/149; 68/213

[56] References Cited

U.S. PATENT DOCUMENTS

| | | | |
|---|---|---|---|
| 1,051,669 | 1/1913 | Boesser | 134/138 |
| 2,831,488 | 4/1958 | Anderson | 134/138 |
| 3,075,534 | 1/1963 | Habostad | 134/138 |
| 3,421,527 | 1/1969 | Dettman | 134/138 |
| 3,428,060 | 2/1969 | Spivey | 134/138 X |
| 3,587,599 | 6/1971 | Bywater | 134/138 |
| 3,688,678 | 9/1972 | Dalen | 134/143 X |
| 3,873,364 | 3/1975 | Smith | 134/138 |
| 4,061,153 | 12/1977 | Doherty | 134/138 |
| 4,130,443 | 12/1978 | Dulin | 134/149 X |
| 4,155,230 | 5/1979 | Lacher, Jr. | 68/213 |

*Primary Examiner*—Robert L. Bleutge
*Attorney, Agent, or Firm*—Don J. Flickinger

[57] ABSTRACT

A pair of frustoconical bearings for supporting a roller-type applicator and carried within an elongate cylindrical container. One of the bearings is affixed to the closed end of the container while the other is affixed to a cap detachably securable to the open end. Cleaning fluid is directed to the applicator from a plurality of orifices spaced along conduits extending longitudinally within the container. The axis of each orifice is at a compound angle to urge rotation of the applicator and to urge the applicator toward the closed end of the container.

9 Claims, 17 Drawing Figures

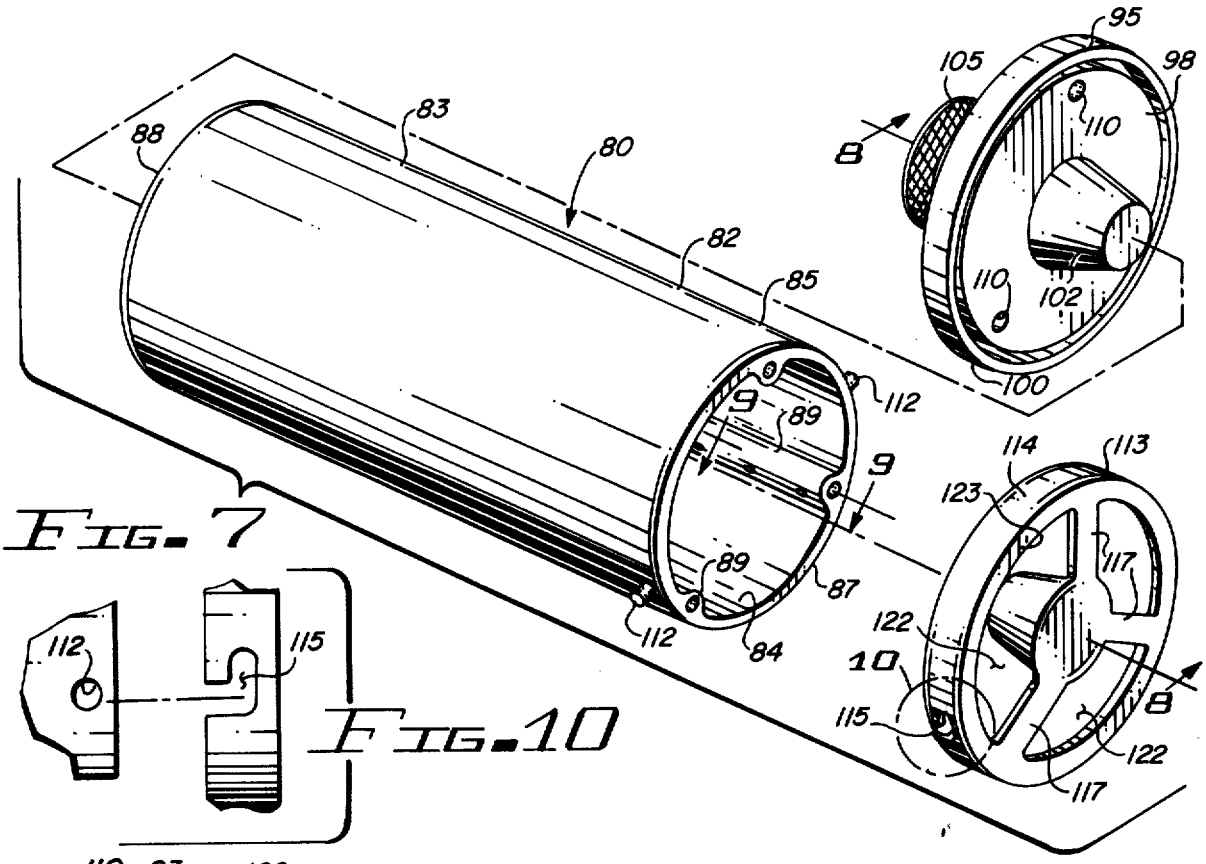
FIG. 7
FIG. 10
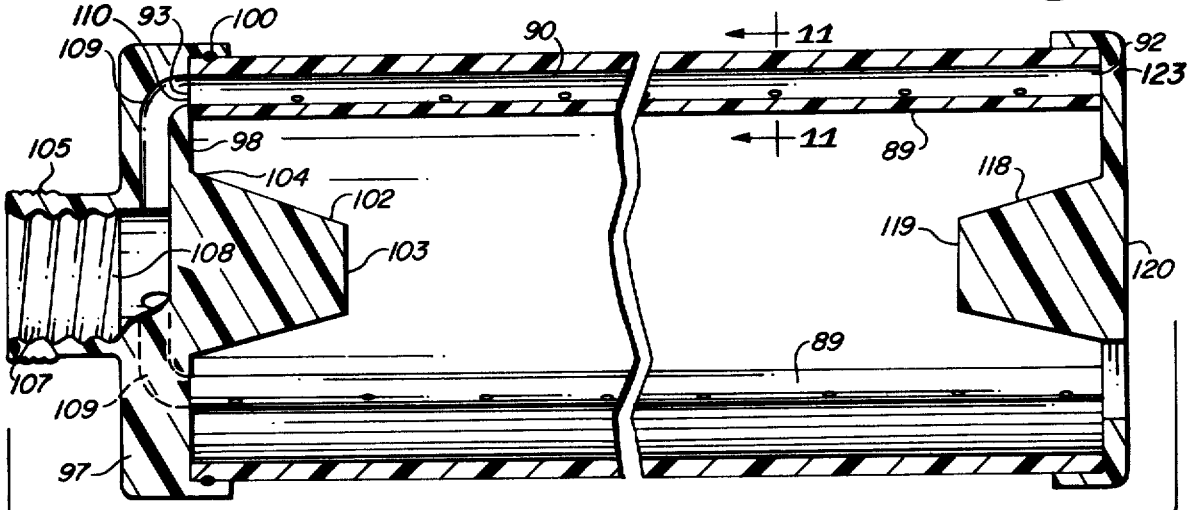
FIG. 8
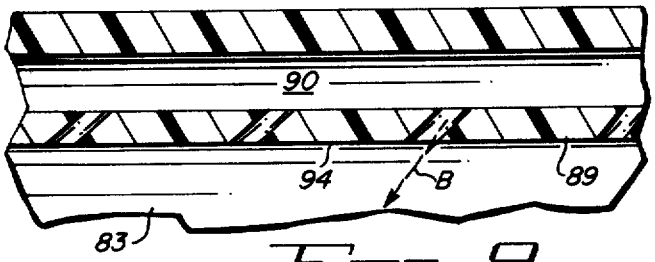
FIG. 9
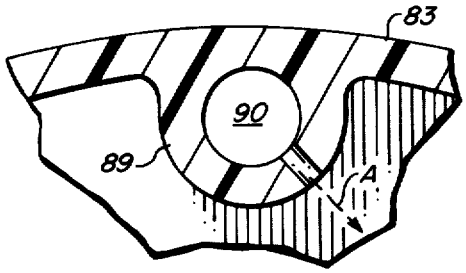
FIG. 11

APPARATUS FOR CLEANING ROLLER APPLICATORS

CROSS REFERENCE TO RELATED APPLICATIONS

The instant application is a continuation-in-part of the common inventor's prior filed co-pending application, Ser. No. 06/097,929 filed Nov. 28, 1979 and entitled APPARATUS FOR CLEANING ROLLER now abandoned.

FIELD OF THE INVENTION

In recent years, the use of roller-type applicators for applying paint has become increasingly popular. Painting with an applicator is substantially easier and faster than painting with a brush, especially on large, flat surfaces such as walls and ceilings. Also, it is generally recognized that relatively less skill is required to produce comparative results.

Typically, a roller-type applicator includes an elongate rigid cylinder having a bore and open ends. Representatively, an applicator is approximately 9 inches long with a bore diameter of 1.50 or 2.25 inches. Fibrous material, or nap, on the outer surface of the cylinder absorbs and holds paint or other liquid. The applicator is fitted over a mandrel rotatably supported on a handled frame. Two general classifications of roller-type applicators are commercially available. A first type, especially devised for professional use, is a durable, long-lasting and expensive tool. A less expensive model is produced for the occasional or the "do-it-yourself" painter.

Professional type applicators are intended to be cleaned and reused. Less expensive models may be considered to be disposable. However, many occasional painters do clean and reuse the less expensive applicators. In recognition thereof, the prior art has proposed various devices to facilitate the cleaning operation.

DESCRIPTION OF THE PRIOR ART

A search of records within the U.S. Patent and Trademark Office was undertaken to determine prior art devices for the foregoing purposes.

U.S. Pat. No. 2,831,488 (Anderson); U.S. Pat. No. 3,587,599 (Bywater); U.S. Pat. No. 4,061,153 (Doherty); U.S. Pat. No. 3,075,534 (Habostad); U.S. Pat. No. 1,051,669 (Boesser); U.S. Pat. No. 3,421,527 (Dettman); U.S. Pat. No. 4,130,443 (Dulin); and U.S. Pat. No. 3,428,060 (Spivey).

U.S. Pat. No. 2,831,488 discloses an apparatus including an upright tubular chamber having a bottom end wall and a hingedly affixed top end wall. Applicators of the type having end walls are supported on a longitudinally extending spindle. An elongate tube, axially affixed within the chamber, has a plurality of apertures which discharge water substantially tangential of the applicator roller.

U.S. Pat. No. 1,051,669 discloses an apparatus in which a drinking glass is held in an inverted position upon a skeleton spinning frame which ideally rotates upon a fixed frame. Upstanding tubes having holes therethrough direct jets of water to the surface of the glass.

U.S. Pat. No. 3,587,599 discloses a paint roller cleaner including a cylindrical housing having a vertical aperture in one side thereof for receiving the roller applicator while attached to the applicator frame. The applicator is manually held in position while a stream of water from a hose nozzle is directed manually against the applicator.

U.S. Pat. No. 3,421,527 discloses a paint roller cleaning aid comprising a generally annular chamber formed of coaxial inner and outer spaced cylindrical side walls. The chamber includes an open end and a closed end. Means are provided at the closed end for supporting the roller. Water, delivered to the space between the cylindrical walls, exits through spray holes directed toward the roller.

U.S. Pat. No. 4,061,153 discloses a paint roller cleaning apparatus including an enclosure with bearings in the end walls for supporting the roller. An elongated rectangular shaped orifice extends along the enclosure for delivering fluid to the roller. A drain resides in the lower portion of the enclosure.

U.S. Pat. No. 4,130,443 discloses an apparatus for cleaning roller applicators which includes a cylindrical container having a hingedly affixed door within the side wall. Roller supports are carried in the end walls. One of the supports is spring-loaded for mounting purposes while the other is motor driven. A pipe having perforated holes extends along the side of the container and directs water toward the applicator.

U.S. Pat. No. 3,075,534 discloses a paint roller cleaner including a cylindrical container having a closed bottom and capped by a lid. The container receives the roller while still attached to the frame and means are provided on the container for holding and supporting the frame. A movable nozzle directs water to the roller.

U.S. Pat. No. 3,428,060 discloses an apparatus for cleaning paint rollers including a generally cylindrical housing having a coaxially extending spindle shaft for supporting the roller. The spindle shaft is rotated in response to water striking a plurality of radial veins at one end thereof. An elongate water delivery tube having openings therein extends within the housing.

For various reasons, including complexity of design and difficulty of use, none of the prior art devices have achieved universal acceptance. It would be highly advantageous therefore to remedy the foregoing and other deficiencies inherent in the prior art.

Accordingly, it is an object of the present invention to provide improved apparatus for cleaning roller type applicators.

Another object of the invention is the provision of an apparatus having improved means for delivering the cleaning fluid to the applicator.

And another object of the invention is to provide an applicator in which the cleaning is integrally accomplished without manual manipulation.

Still another object of this invention is the provision of a cleaning apparatus which is readily attachable to a conventional garden hose or other source of appropriate cleaning fluid.

Yet another object of the invention is to provide a cleaning apparatus of unencumbered simplified construction.

Yet still another object of the invention is the provision of a cleaning apparatus having improved fluid flow characteristics for increased agitation and thorough cleansing of the applicator.

A further object of the instant invention is to provide a relatively inexpensive apparatus for professional use and to render practical the cleaning of "disposable" applicators.

And a further object of the invention is the provision of a cleaning apparatus in which splashing fluids are contained and can be drained in a selected direction.

Still a further object of the invention is to provide a device which will interchangeably accommodate variously dimensioned rollers.

And still a further object of the invention is the provision of a relatively lightweight, durable and maintenance free apparatus for cleansing a roller-type applicator.

Yet still a further object of the invention is the provision of an apparatus of the above type which is quickly and conveniently usable.

SUMMARY OF THE INVENTION

Briefly, to achieve the desired objects of the instant invention, in accordance with a preferred embodiment thereof, provided is a container having a continuous side wall with a closed end and an open end. A cap having fluid drainage openings therethrough is detachably securable with the open end of the container. A bearing for rotatably supporting one end of an applicator is carried by the closed end of the container. A similar axially aligned bearing is carried by the cap. Fluid transfer means are also provided for receiving pressurized fluid and for tangentially directing the fluid toward the applicator.

More specifically, the fluid transfer means includes a manifold carried at the closed end of the container and having connection means for attachment to a conventional garden hose or other source of pressurized fluid. An elongate delivery conduit extends from the manifold longitudinally within the container. A plurality of orifices are spaced along the delivery conduit for discharge of the fluid from the conduit. Each of the orifices is at a compound angle for tangentially directing streams of the fluid solvent toward the outer surface of the applicator and concurrently for directing the streams toward the closed end of the container.

Preferably, in accordance with one embodiment of the invention, the bearings are frustoconical having a convergent end with a diameter smaller than the bore of the applicator and a divergent end of a diameter greater than the bore of the applicator. In accordance with an alternate embodiment of the invention, the bearings comprise concentric cylindrical surfaces. The bearings which have smooth outer surfaces are nonrotatable. Accordingly, the rigid core of the applicator rotates relative the bearings.

BRIEF DESCRIPTION OF THE DRAWINGS

The foregoing and further and more specific objects and advantages of the instant invention will become readily apparent to those skilled in the art from the following detailed descriptions of preferred embodiments thereof taken in conjunction with the drawings, in which:

FIG. 7 is an exploded perspective view of an alternate embodiment of a cleaning apparatus embodying the teachings of the instant invention;

FIG. 8 is an enlarged vertical sectional view taken along the line 8—8 of FIG. 7 and showing the components thereof as they would appear when assembled;

FIG. 9 is an enlarged fragmentary sectional view taken along the line 9—9 of FIG. 7;

FIG. 10 is an enlarged fragmentary elevation view specifically showing a preferred means of attaching two of the components illustrated in FIG. 7;

FIG. 11 is an enlarged fragmentary vertical sectional view taken along the line 11—11 of FIG. 8;

DESCRIPTION OF THE PREFERRED EMBODIMENTS

Figure 1:
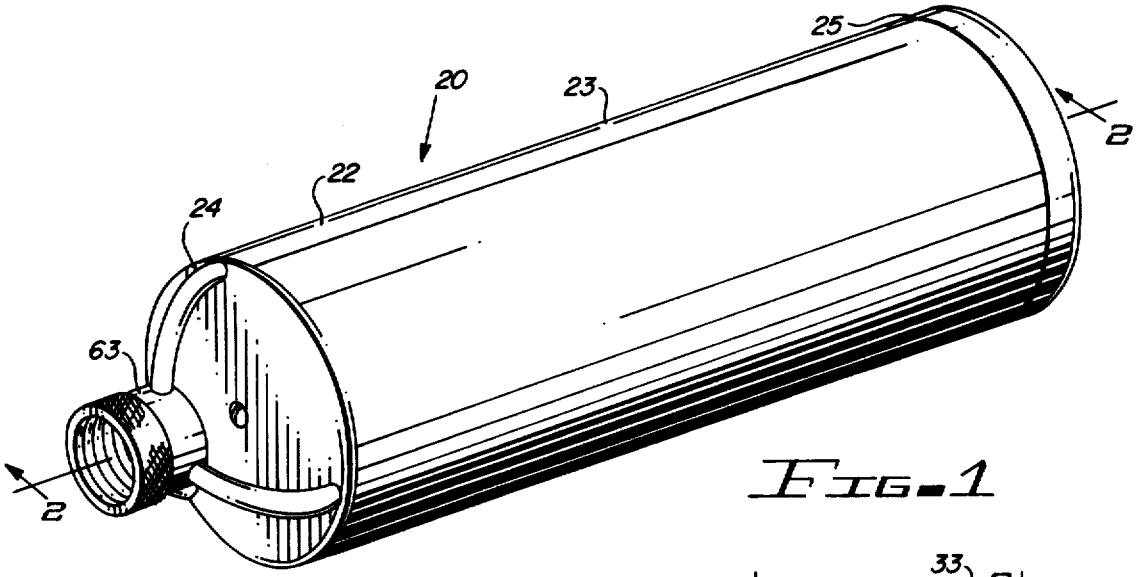
FIG. 1 is a perspective view of an apparatus constructed in accordance with the teachings of the instant invention for cleaning roller-type applicators.

Turning now to the drawings in which like reference characters indicate corresponding elements throughout the several views, attention is first directed to FIG. 1 which shows an apparatus, generally designated by the reference character 20, constructed in accordance with the teachings of the instant invention for cleaning roller-type applicators. Apparatus 20 includes elongate container 22 including continuous side wall 23 and ends 24 and 25.

Figure 2:
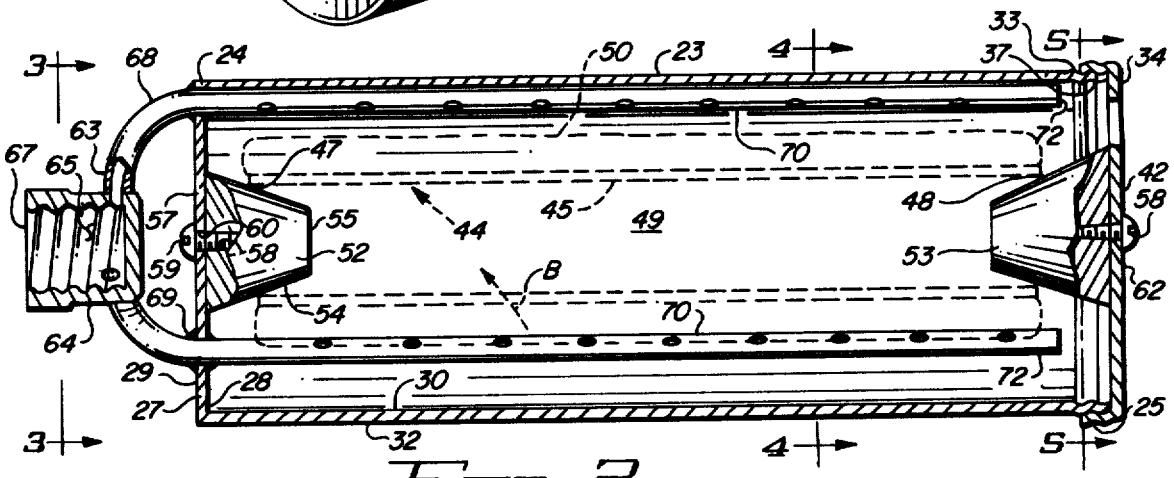
FIG. 2 is a vertical sectional view taken along the line 2—2 of FIG. 1.

End 24, as better illustrated in FIG. 2, is closed by end wall 27 having inner surface 28 and outer surface 29. Correspondingly, side wall 23 includes inner surface 30 and outer surface 32. External threads 33 are formed into side wall 23 in the area of end 25 which is open.

Figure 5:
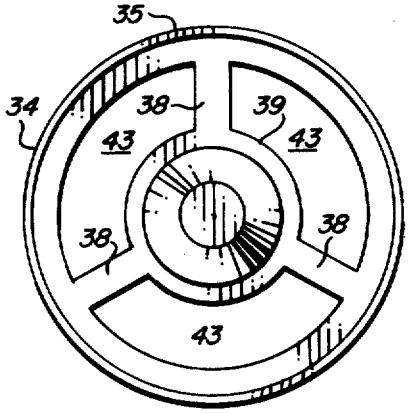
FIG. 5 is a vertical sectional view taken along the line 5—5 of FIG. 2
Figure 4:
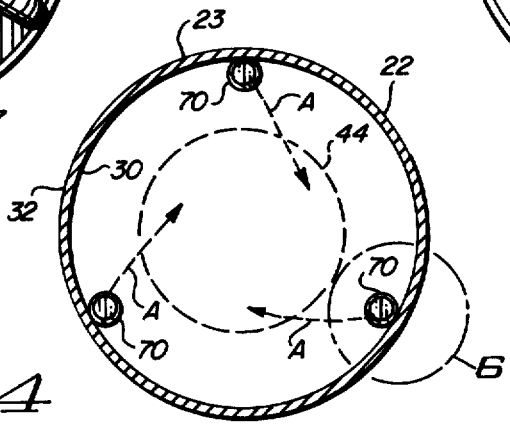
FIG. 4 is a vertical sectional view taken along the line 4—4 of FIG. 2.

A cap 34, as further viewed in FIG. 5, is detachably securable with open end 25. Cap 34 includes continuous rim 35 sized and shaped to receive open end 25 therein and having internal thread 37 matingly engagable with external thread 33. Support legs 38 extend inwardly from rim 35 and carry bearing support element 39 having inner surface 40 and outer surface 42. Legs 38 are spaced apart defining fluid drainage openings 43 therebetween.

Container 22 is of sufficient size to enclose a roller-type applicator. A typical applicator is illustrated in broken outline in FIG. 2 and generally designated by the reference character 44. Conventionally, applicators of the type include an elongate rigid cylindrical core 45 having open ends 47 and 48 and bore 49 therethrough. A fibrous material 50, especially selected for absorbing and holding paint of other liquids, encases core 45.

Applicator 44 is rotatably supported within container 22 by a pair of spaced apart axially aligned bearings 52 and 53. Bearings 52 and 53 are generally analogous, being frustoconical with tapered side wall 54 and convergent end 55. Threaded aperture 58 extends inwardly from divergent end 57. Screw 59, extending through opening 60 in end wall 27, engages threaded aperture 58 for securing divergent end 57 against inside surface 28. A second screw 59, passing through opening 62 and bearing support element 39, secures divergent end 57 of bearing 53 against inner surface 40.

Figure 3:
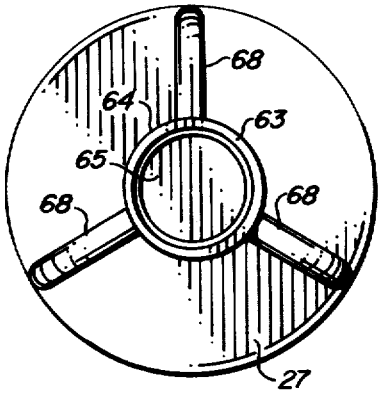
FIG. 3 is an end elevation view taken from the left end of the illustration of FIG. 1.

Fluid transfer means for receiving pressurized fluid and directing the fluid to applicator 44 includes manifold 63 carried at the closed end of container 22. With further reference to FIG. 3, it is seen that manifold 63 includes a generally cup-shaped element 64 having fluid receiving chamber 65 therein. Internal thread 67 integral with cup-shaped element 64 provides for attachment to a source of pressurized fluid. In accordance with the immediate embodiment of the invention, internal thread 67 is sized and shaped to receive the connection end of a conventional garden hose. Inlet conduits 68, extending from cup-shaped element 64 and passing through openings 69 in end wall 27, communicate between chamber 65 and elongate delivery conduits 70 within container 22.

Figure 6:
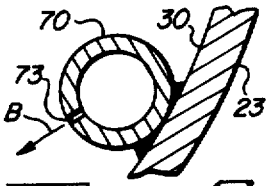
FIG. 6 is an enlarged fragmentary sectional view taken from within the inset designated 6 in FIG. 4.

The immediately preferred embodiment of the invention contemplates three delivery tubes, in the form of conduits 70, which are equiangularly spaced and affixed to the inner surface 30 of sidewall 23. Each delivery conduit 70 has a closed free end 72. A plurality of orifices 73, as more clearly illustrated in FIG. 6, are spaced along each delivery conduit 70. Each orifice 73 is formed at a compound angle. Each orifice 73 is angled in a first direction as indicated by the broken line arrow A for directing a steam of fluid generally tangential to applicator 44 for urging rotation thereof, or applying a torque thereto. Each orifice 73 is further angled for directing the respective stream of water towards closed end 24 as indicated by the broken line arrow B in FIG. 2.

The foregoing embodiment of the instant invention, generally designated by the reference character 20, is especially adapted for fabrication by conventional metal working techniques. Sidewall 23 and end wall 27 are preferrably fabricated of relatively light gauge sheet metal as is cap 34. Cup-shaped element 64, inlet conduits 68 and delivery conduits 70 may be fabricated of commercially available brass tubing. The several components are joined by soldering, brazing or other conventional techniques. Bearings 52 and 53 may be fabricated of plastic, wood or other suitable material.

FIG. 7 illustrates an alternative embodiment of the invention generally designated by the reference character 80 which is especially adapted to be fabricated of a suitable plastic material by molding or other conventional means.

In general similarity to the foregoing embodiment, the immediate embodiment includes container 82 have continuous sidewall 83 with inner surface 84 and outer surface 85. Container 82 further includes open end 87 and an opposite end 88.

Three equiangulary spaced delivery tubes or conduits, as further viewed in FIG. 8, are integrally formed within sidewall 83. Each conduit 89 includes a bore 90 extending longitudinally of container 82 and having open ends 92 and 93 coincident with ends 87 and 88, respectively. A plurality of orifices 94, formed at compound angles, as indicated by the arrowed broken lines A and B in FIGS. 9 and 11, and as previously described in connection with orifices 73, extend along each delivery conduit 89.

End member 95, in which several of the previously described elements are formed, is permanently affixed to end 88 of container 82 by a suitable bonding agent. End member 95 includes end wall 97 having inner surface 98 and outer surface 99. Annular lip 100 extends from inner surface 98 to encircle the outer surface 85 of sidewall 83. Frustoconical bearing 102, having convergent end 103 and divergent end 104, also projects from inner surface 98. Tubular projection 105, having internal thread 107, forms connection means for attachment to a garden hose or other source of pressurized fluid. Chamber 108 resides partly within end wall 97 and partly within tubular projection 105. Inlet conduits 109 extend from fluid chamber 108. Each inlet conduit 109 concludes with an opening 110 in inner surface 98 aligned with the end 93 of a respective delivery conduit 89. Tubular projection 105, chamber 108 and inlet conduits 109 comprise a manifold analogous to the manifold 63 described in connection with the foregoing embodiment of the invention.

A pair of diametrically opposed lug 112 project from the outer surface 85 of container 82 proximate open end 87. Cap 113 having annular rim 114 is detachably securable to open end 87 of container 82. Rim 114 is sized to receive container 82 therein. A pair of diametrically opposed L-shaped slots 115, carried by rim 114, is more clearly viewed in FIG. 10, and are engagable with lugs 112. Although only one slot 115 is herein illustrated, it will be appreciated that a second identical diametrically opposed slot is carried by rim 114. Legs 117 extending inwardly from rim 114 support frustoconical bearing 118. Frustoconical bearing 118 is axially aligned with bearing 102 and in general similarity thereto includes convergent end 119 and divergent end 120. In the immediate embodiment, divergent end 120 functions as the bearing support. Fluid drainage openings 122 are defined between legs 117. As noted in FIG. 8, lip 123, projecting inwardly from rim 114, closes end 92 of each conduit 89 when cap 113 is engaged with container 82.

Figure 12:
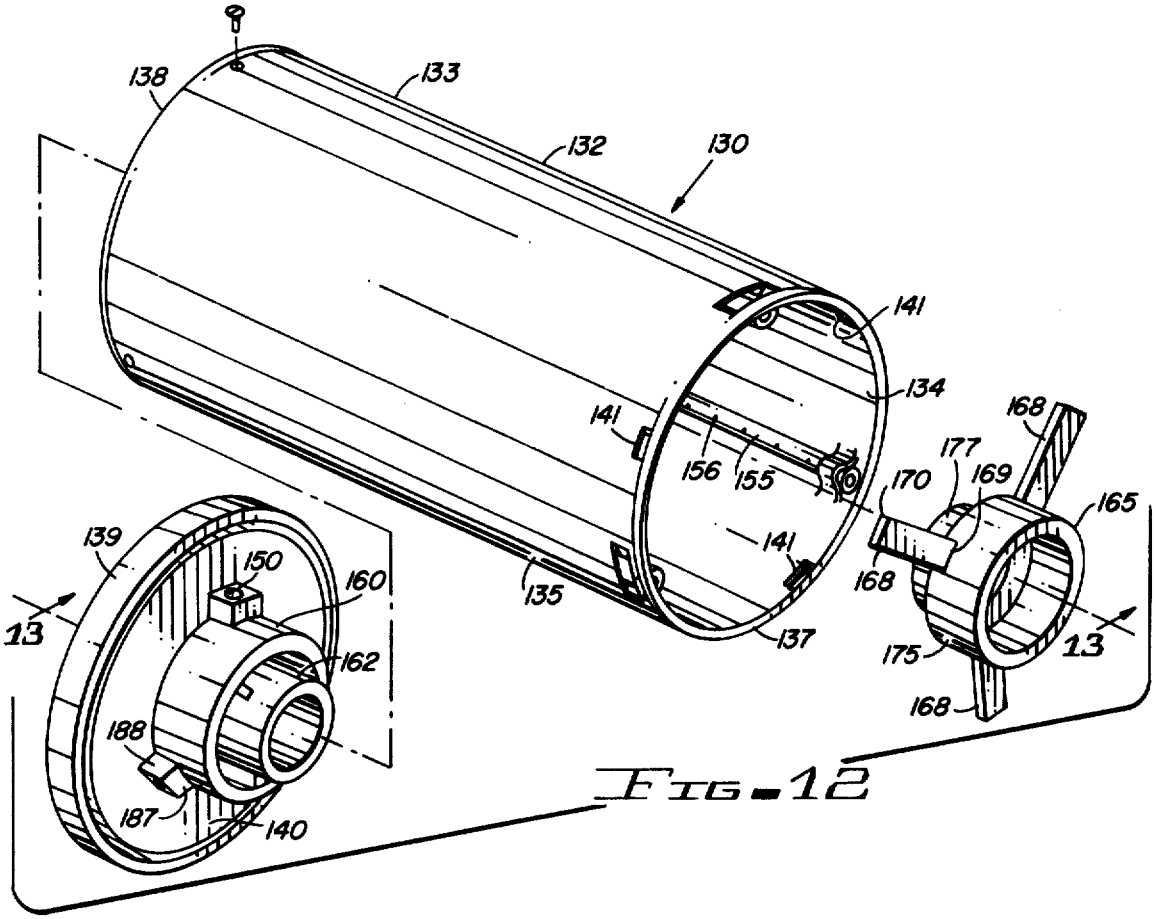
FIG. 12 is an exploded perspective view of yet another alternate embodiment of the instant invention.

With reference to FIG. 12, there is seen another embodiment of the invention generally designated by the reference character 130, which, analogous to the previously described embodiments, includes container 132 having continuous side wall 133 with inner surface 134 and outer surface 135. Container 132 further includes open end 137 and an opposite end 138. A plurality of equally spaced openings 141 extend radially through side wall 133 proximate open end 137. While the exact number of openings 141 may vary within the scope of the instant invention, three have been chosen for purposes of illustration.

Figure 13:
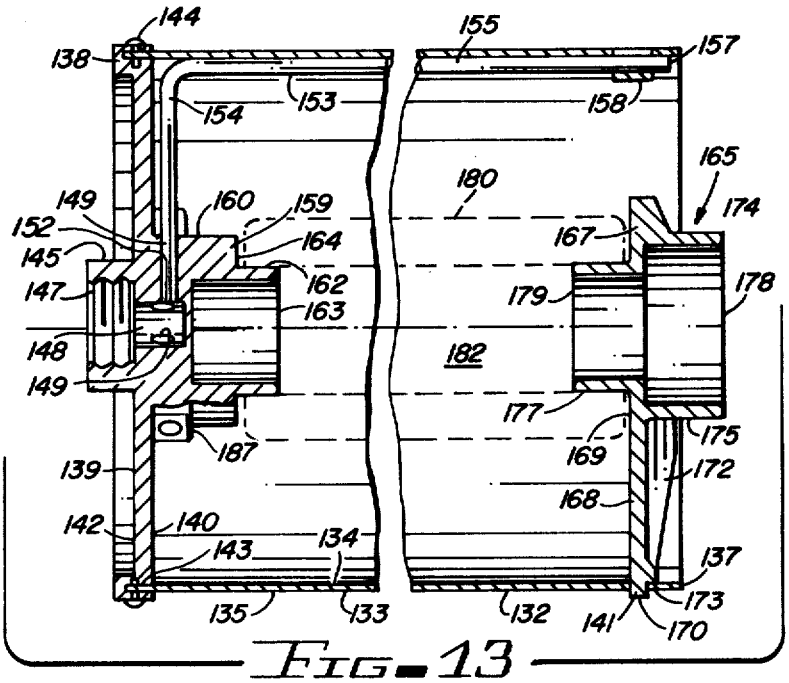
FIG. 13 is an enlarged fragmentary vertical sectional view taken along the line 13—13 of FIG. 12, the components thereof being shown in the assembled position.

End 138 of container 132, as further illustrated in FIG. 13, is closed by end wall 139 having inner surface 140 and outer surface 142. An annular groove 143 extends inwardly from inner surface 140. End 138 is received within groove 143 and secured thereby by suitable mechanical fasteners such as drive screws 144.

In general similarity to the foregoing embodiment generally designated by the reference character 80, the immediate embodiment includes a tubular projection 145 having internal thread 147 extending from outer surface 142 and forms connection means for attachment to a garden hose or other source of pressurized fluid. Chamber 148, having inlet conduits 149 extending radially therefrom, resides within end wall 139 for communication with the source of pressurized fluid. Integral with each inlet conduit 149 is a counter bore 150 in which is received the inlet end 152 of elongate delivery conduit 153. Each delivery conduit 153 includes a first section 154 extending along inner surface 140 radially from chamber 148 and a second section 155 extending longitudinally of container 132 in juxtaposition with inner surface 134. A plurality of orifices 156, analogous to previously described orifices 73, are spaced along each delivery conduit 153.

For purposes of illustration, the immediate embodiment of the invention includes three delivery conduits 153 having equally spaced second sections 155 residing intermediate openings 141. Each second section 155 terminates with a closed free end 157 proximate open end 137 of container 132. Each delivery conduit 153 is secured to container 132, proximate the closed free end 157 thereof, by arcuate band 158. Preferably, container 132 is fabricated of relatively thin metal. In accordance with techniques well known to those skilled in the art of metal working, each arctuate band 158 is readily formed by cutting and pressing inwardly.

A bearing 159 having first and second concentric cylindrical surfaces 160 and 162, respectively, projects from inner surface 140 of end wall 139. Cylindrical surface 162, being smaller in diameter than cylindrical surface 160, terminates with a free end 163 projecting beyond the free end 164 of cylindrical surface 160. The other end of each cylindrical surface 160 and 162 is fixed to end wall 139. Preferably, end wall 139 and bearing 159, including cylindrical surfaces 160 and 162, are integrally formed such as from molded plastic or cast metal.

A cap 165 is detachably securable to open end 137 of cylindrical container 132. Cap 165 includes centrally located bearing support element 167 having support legs 168 extending radially therefrom. While the actual number is optionally variable, three legs 168 have been chosen for purposes of illustration. Each leg 168 includes a fixed end 169 secured to bearing support element 167 and a free end 170. Each free end 170 is sized to be received through a respective opening 141. Reinforcing element 172 extending along each leg 168 terminates with shoulder 173 which abuts inner surface 134, as specifically illustrated in FIG. 13, thereby centrally locating bearing support element 167.

A second bearing 174 is carried by bearing support element 167 in axial alignment with bearing 159. Similar to previously described bearing 159, bearing 174 includes first cylindrical surface 175 and concentric second cylindrical surface 177. Cylindrical surfaces 177 and 175, which extend in opposite directions from bearing support element 167, terminate with free ends 178 and 179, respectively. Cylindrical surface 175 has a diameter corresponding to the diameter of cylindrical surface 160 while cylindrical surface 177 has a diameter corresponding to the diameter of cylindrical surface 162.

Cap 165 is reverseably engagable with container 132. It is also noted, for purposes of which will be explained presently, that cylindrical surfaces 175 and 177 are offset longitudinally with respect to the plane of legs 168. With particular reference to FIG. 13, it is seen that cap 165 is engaged with container 132 such that the smaller, or first cylindrical surface 177, projects inwardly. An applicator 180, having a smaller sized bore 182, is shown in broken outline as it would appear when rotatably supported upon bearing surfaces 162 and 177. Applicator 180 resides between free end 164 of cylindrical surface 160 and legs 168 to prevent axial movement sufficient for disengagement from one of the cylindrical surfaces.

Figure 14:
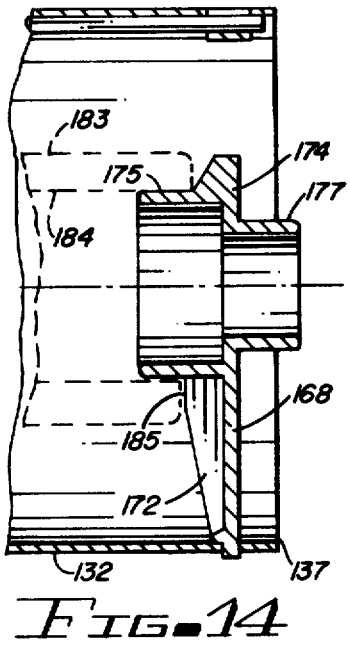
FIG. 14 is a view generally corresponding to the right-hand end of the illustration of FIG. 13 and showing an alternate assembly of the elements thereof.

An applicator 183 having a bore 184 of greater diameter, shown in broken outline, is illustrated in FIG. 14 as it would appear when rotatably supported upon the larger, or first cylindrical surfaces 160 and 175. Applicator 183 resides between surfaces 185 integral with reinforcing elements 172 and inwardly directed surface 187 integral with boss 188 into which counter bore 150 extends. In accordance with commercial practice, applicator 183, although having a bore of greater diameter, is of the same length as applicator 180. In accordance with the offset of bearing 174, the longitudinal distance between end 164 and leg 168, as illustrated in FIG. 13, is substantially equal to the longitudinal distance between surfaces 185 and 187 as illustrated in FIG. 14.

Manual manipulation of the cleaning apparatus of the instant invention is exceedingly simple. Initially, the cap is removed from the container. In accordance with the embodiment generally designated by the reference character 20, cap 34 is rotated relative cylinder 22. The embodiment generally designated by the reference character 80, having a variation of the well known bayonet-type connection, requires that cap 113 be rotated through a few degrees then withdrawn axially from container 82. The applicator, having been previously removed from the frame, is entered into the chamber and the cap replaced. It is noted that the bearings, being frustoconical, are self-aligning. That is, the convergent end of the bearings will automatically enter the bore of the applicator during the aforegoing manipulation.

Figure 15A:
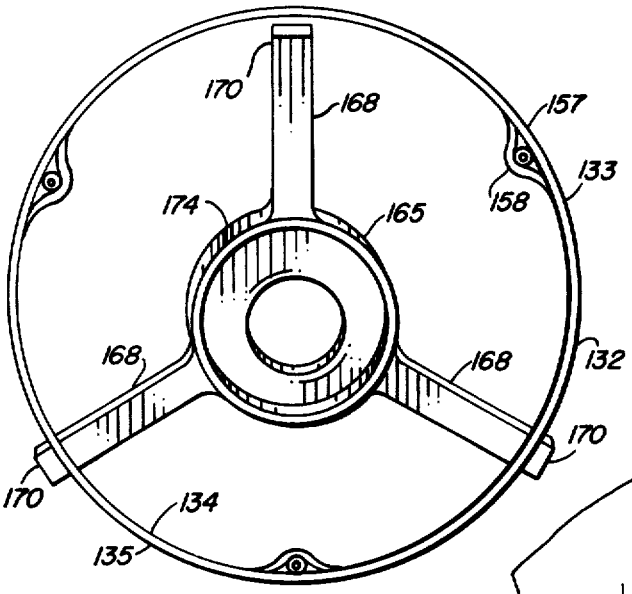
FIG. 15A is an end elevation view taken from the right-hand end of FIG. 13 illustrating the components thereof during an initial phase of assembly.
Figure 15B:
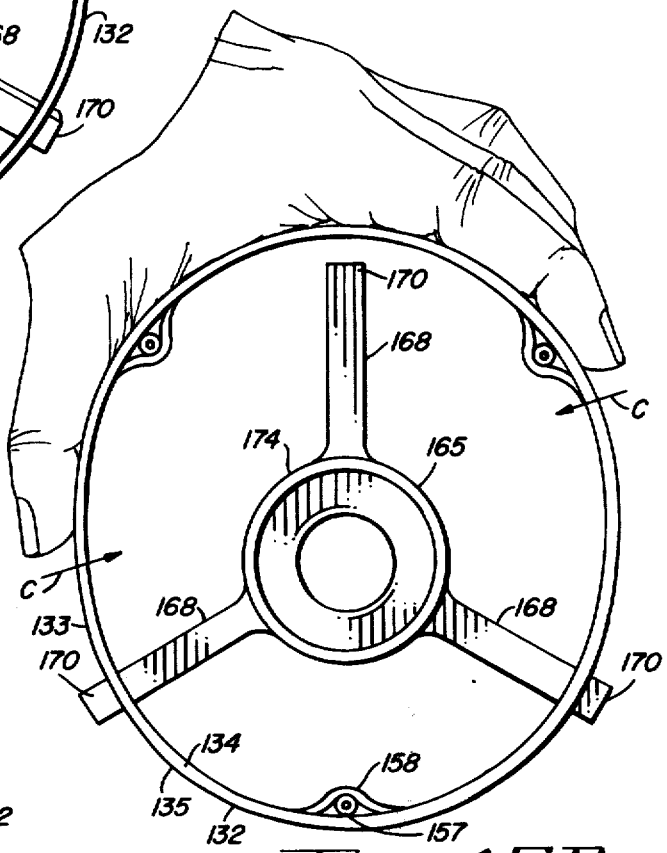
FIG. 15B is a view generally corresponding to the view of FIG. 15A and illustrating the components thereof during an intermediate phase of assembly.
Figure 15C:
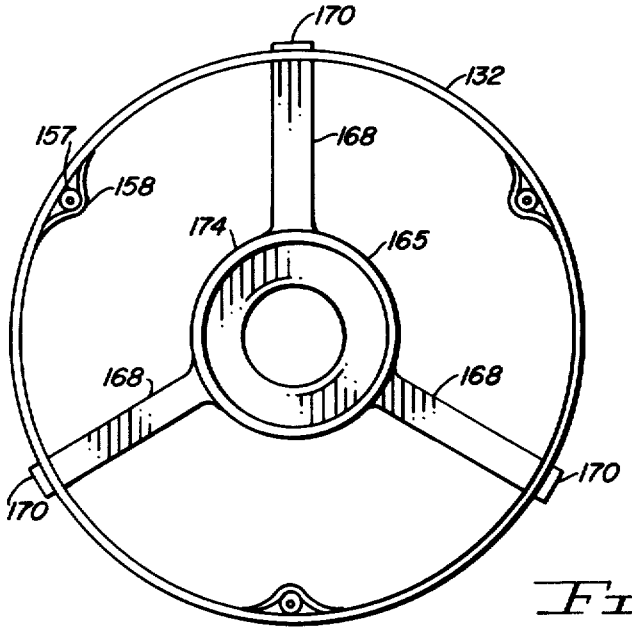
FIG. 15C is a view generally corresponding to the view of FIG. 15A illustrating the components thereof after final assembly as shown in FIG. 13.

Sequentially illustrated in FIGS. 15A–15C are the steps of assembling cap 165 with container 132. The center of each opening 141 defines the apex of an equilateral triangle. The distance between openings, as measured along a side of the equilateral triangle, has a measurable length. The centers of the free ends 170 of the legs 168 similarly define an equilateral triangle. The equilateral triangle defined by ends 170 is larger than the equilateral triangle defined by openings 141. Accordingly, the distance between ends 170 is of greater length than the length between openings 141. It is upon this fact that cap 165 is retained in engagement with container 132.

Assembly of cap 165 with container 132 is initiated, as illustrated in FIG. 15A, by inserting the ends 170 of two arbitrarily chosen legs 168 through two arbitrarily chosen openings 141. During this assembly, cap 165 is tilted at a slight angle such that the other leg 168 resides forward of open end 137. The extent to which each leg 168 can be passed through the respective opening 141 is limited by the abutment of shoulder 173 against inner surface 134 of side wall 133.

Being fabricated of relatively thin-walled stock and being without bracing, container 132 adjacent open end 137 is resiliently deformable. In response to the application of pressure, in the direction of arrowed line C as shown in FIG. 15B, the normally cylindrical container 132 assumes a substantially oval shape. The deformation effectively increases the straight line length between each previously chosen opening 141 and the unchosen opening 141. The increase in length provides clearance between free end 170 of the previously unchosen leg 168 and the inner surface 134 of side wall 133. The previously unselected leg 168 is then moved rearwardly in alignment with the respective opening 141. With the relaxation of pressure, container 132 again assumes the normal cylindrical configuration during which, as illustrated in FIG. 15C, the previously unselected leg 168 is received through the respective opening 141. Removal of cap 165 is a reverse of the foregoing procedure.

The device is then connected to a convenient source of pressurized fluid. For certain types of paint which are watersoluble while still in the liquid state, the device is conveniently attached to a conventional garden hose. Finally, the drainage openings are directed away from the user toward an available drain area and the flow of cleaning fluid is commenced.

During operation, fluid entering the chamber is directed through the inlet conduits to the delivery conduits. The fluid is then forceably discharged through the orifices to impinge upon the outer surface of the applicator. As a result of the first angle of the orifices, indicated by the broken line A, the applicator is caused to rotate to distribute solvent to all portions of the fibrous covering. The concurrent direction of the fluid, as indicated by the broken line B, prohibits swift drainage or runnoff of the fluid and increases turbulation, or turbulent flow, within the container thereby accelerating the cleaning action. The latter direction of the fluid also urges the applicator toward the end wall thereby relieving strain on the end cap and permitting the use of larger drainage openings.

Various changes and modifications of the embodiments herein chosen for purposes of illustration will readily occur to those skilled in the art. For example, the embodiments of the invention have been described as having connection means especially adapted for attachment to a conventional garden hose. Other types of connection means are contemplated such as a nipple for attachment of a flexible tube or a conventional pipe thread. Alternate connections are especially useful for attaching the device to commercially available recirculating tank type cleansing machines utilizing various especially prepared solvents. Also, while the preferred embodiments includes three equiangularly spaced delivery tubes, alternate numbers and arrangement of tubes are within the spirit of the invention. An embodiment having a single delivery tube will clean an applicator, however, greater time for the cleaning operation is required. Further, the size and number of orifices within each tube are subject to wide variation. Orifices having a diameter of approximately 0.040 inches and angled at approximately 45 degrees are set forth as exemplary. To the extent that such modifications and variations do not depart from the spirit of the invention, they are intended to be included within the scope thereof which is assessed only by a fair interpretation of the following claims.

Having fully described and disclosed the present invention and alternately preferred embodiments thereof in such clear and concise terms as to enable those skilled in the art to understand and practice the same, the invention claimed is:

1. An apparatus for holding a roller-type applicator, which applicator includes:

an outer generally cylindrical surface, a centrally located bore, and a pair of opposed open ends, and for receiving pressurized liquid from a source thereof and for utilizing said liquid to rotate and clean said applicator, said apparatus comprising:

a. a container including i. a continuous side wall, ii. a closed end, and iii. an open end;

b. a cap detachably securable with the open end of said container and having fluid drainage means therethrough, said cap having i. a generally centrally located bearing support element carrying the other of said bearings, ii. at least two spaced apart arms extending outwardly from said bearing support element and having spaces therebetween defining said fluid drainage means, and iii. attachment means for detachably securing said cap to said container, said attachment means including a plurality of openings extending through the side wall of said container proximate the open end thereof, said openings sized and spaced to receive a terminal portion of said legs therethrough, and stop means carried by end of said legs for abutting the side wall of said container and limiting the length of the terminal portion of said legs received through said openings;

c. a pair of spaced apart axially aligned bearings for rotatably supporting said applicator, one of said bearings being carried by the closed end of said container, the other of said bearings being carried by said cap; and d. fluid transfer means carried by said housing for receiving said pressurized fluid and for directing said fluid toward said applicator.

2. The apparatus of claim 1, wherein:

a. each said leg includes a free end, the free end of one of said legs being spaced at a distance from the free end of another said leg a distance greater than the distance between the respective openings through which said legs are received; and b. said container is deformable to increase the distance between said respective openings to receive the free ends of said legs.

3. An apparatus for holding a roller-type applicator, which applicator includes an outer generally cylindrical surface, a centrally located bore, and a pair of opposed open ends, and for receiving pressurized liquid from a source thereof and for utilizing said liquid to rotate and clean said applicator, said apparatus comprising:

a. a container including i. a continuous side wall, ii. a closed end, and iii. an open end;

b. a cap detachably securable with the open end of said container and having fluid drainage means therethrough;

c. a pair of spaced apart axially aligned bearings for rotatably supporting said applicator, one of said bearings being carried by the closed end of said container, the other of said bearings being carried by said cap, each of said bearings including i. a first cylindrical element having a fixed end and a free end; and ii. a second cylindrical element having a fixed end and a free end, said second cylindrical element having a diameter smaller than the diameter of said first cylindrical element; and d. fluid transfer means carried by said housing for receiving said pressurized fluid and for directing said fluid toward said applicator.

4. The apparatus of claim 3, wherein the fixed end of said second cylindrical element is coaxially affixed to the free end of said first cylindrical element.

5. The apparatus of claim 3, wherein a. the fixed end of said first cylindrical element is affixed to one side of said cap; and b. the fixed end of said second cylindrical element is affixed to the other side of said cap.

6. Apparatus for holding a roller-type applicator, said applicator including an outer generally cylindrical surface, a centrally located bore, and a pair of opposed ends, and adapted to receive a pressurized solvent from a source thereof to rotate and clean said applicator, said apparatus comprising:

a. a container including i. a side wall, ii. a closed end, and iii. an open end;

b. a gap detachably securable with the open end of said container and having fluid drainage means therethrough;

c. a pair of spaced apart axially aligned bearings for rotatably supporting said applicator, one of said bearings being carried by the closed end of said container, the other of said bearings being carried by said cap; and d. fluid transfer means including i. elongate delivery conduit means extending longitudinally within said container, and ii. a plurality of orifices spaced along said delivery conduit means for directing streams of solvent toward the outer surface of the applicator to cause the applicator to rotate and for directing the streams of solvent toward the closed end of the container to increase the turbulence of the solvent.

7. Apparatus as defined in claim 6 in which the solvent is water.

8. Apparatus for holding a roller-type applicator, said applicator including an outer generally cylindrical surface having a nap, a centrally located bore, and a pair of opposed ends, and adapted to receive a pressurized solvent from a source thereof to rotate and clean said applicator, said apparatus comprising:

a. a container including i. a side wall, ii. a closed end, and iii. an open end;

b. a cap detachably securable with the open end of said container and having fluid drainage means therethrough;

c. a pair of spaced apart axially aligned bearings for rotatably supporting said applicator, one of said bearings being carried by the closed end of said container, the other of said bearings being carried by said cap; and d. fluid transfer means including i. elongate delivery conduit means extending longitudinally within said container, and ii. a plurality of orifices formed along said conduit means, each orifice being at a compound angle for tangentially directing a stream of solvent toward the outer surface of the applicator to apply a torque to the applicator to cause the applicator to rotate in a given direction and toward the closed end of the container to increase the turbulence of the flow of the solvent through the nap.

9. Apparatus as defined in claim 8 in which the solvent is water.

* * * * *